US006951038B1

(12) United States Patent
Ganoe, Sr.

(10) Patent No.: US 6,951,038 B1
(45) Date of Patent: Oct. 4, 2005

(54) ADJUSTABLE PILLOW FOR THE PROPER ALIGNMENT OF THE HEAD, NECK, AND SPINE

(76) Inventor: Billy D. Ganoe, Sr., 70 Walton La., Hurley, NY (US) 12443

( * ) Notice: Subject to any disclaimer, the term of this patent is extended or adjusted under 35 U.S.C. 154(b) by 36 days.

(21) Appl. No.: 10/959,882

(22) Filed: Oct. 7, 2004

(51) Int. Cl.[7] ..... A47G 9/00
(52) U.S. Cl. ..... 5/644; 5/636
(58) Field of Search ..... 5/644, 636, 640, 5/643, 645, 713, 655.3

(56) References Cited

U.S. PATENT DOCUMENTS 2,942,281 A * 6/1960 Cole ..... 5/644
3,251,075 A * 5/1966 Saltness et al. ..... 5/644
3,568,227 A 3/1971 Dunham
4,501,034 A 2/1985 Greenwalt
4,724,560 A 2/1988 Christie
4,805,603 A 2/1989 Cumberland
4,829,614 A 5/1989 Harper
4,979,249 A 12/1990 Meade, II
5,068,933 A 12/1991 Sexton
5,249,319 A * 10/1993 Higgs ..... 5/714
5,771,514 A * 6/1998 Wilhoit ..... 5/644
6,047,425 A * 4/2000 Khazaal ..... 5/644
6,131,219 A 10/2000 Roberts
6,327,725 B1 * 12/2001 Veilleux et al. ..... 5/644
6,546,579 B1 * 4/2003 Leventhal et al. ..... 5/655.3

* cited by examiner

*Primary Examiner*—Alexander Grosz

(57) ABSTRACT

An adjustable air pillow includes an internal air bladder that can be incrementally inflated and deflated so that a conformable padding with a recessed upper surface that completely encloses the air bladder can support and elevate the individual's head, neck and spine for obtaining the proper alignment thereof for rest, relaxation or sleep. The incremental inflation and deflation of the air bladder is controlled from a control box that encloses an air pump interconnected to the air bladder by a flexible air line, and the control box can be powered by batteries or by plugging the control box into a standard wall outlet for being powered by normal house current.

7 Claims, 4 Drawing Sheets

ADJUSTABLE PILLOW FOR THE PROPER ALIGNMENT OF THE HEAD, NECK, AND SPINE

FIELD OF THE INVENTION

The present invention pertains to portable comfort devices, and more particularly pertains to a selectively adjustable air pillow for properly aligning the head, neck and spine to obtain maximum comfort during periods of rest, relaxation and sleep.

BACKGROUND OF THE INVENTION

It is well known that the proper support and alignment of the head, neck and spine is a crucial factor in obtaining a sound, satisfying and restful sleep. Contrawise, the insufficient support and alignment of the head, neck and spine can interfere with, and completely impede, the ability to obtain a sound and restful night's sleep producing stiffness, soreness and tiredness that can last for days. This is especially the case for people with neck and cervical problems such as arthritis and disc and lumbar ailments. Moreover, it is also well known that different individuals need or require pillows of different shape, height, "give", and firmness. For example, a pillow that is too thin and unsupportive of the critical areas—head, neck, and spine—of the individual's body results in poor sleep, waking up tired, headaches and neck aches, and having a drained, sleepy feeling all day. On the other hand, a pillow that is too thick and unyielding also produces the above results. But a pillow that is overcomes these defects provides the individual with a restful night's sleep and results in the individual waking up refreshed, rejuvenated, energized and having daylong stamina and vigor.

Thus, manufacturers and retailers have produced and made available a wide variety of pillows of different shapes and firmnesses, with each make and design of pillow intended to meet the different needs of many different individuals—but all with the aim of providing the individual with a sound, satisfying, restful night's sleep. However, even with this wide variety of pillows available, an individual may try many different pillows, expending both time and money, before finding the appropriate pillow; or, the individual may be unable to find just the right pillow and may simply have to endure fitful, uncomfortable sleep and long periods of daylight soreness, stiffness and tiredness. And, of course, all these problems are exacerbated for individuals suffering from arthritic conditions or disc and lumbar ailments.

The prior art discloses a number of devices designed to comfortably support the head, neck and upper torso of a resting, reclining or sleeping individual.

For example, the Dunham patent (U.S. Pat. No. 3,568,227) discloses an inflatable cushion of double-walled construction having a bladder formed by two interconnecting cells.

The Greenawalt patent (U.S. Pat. No. 4,501,034) discloses an inflatable pillow that includes several independently inflatable elements for receiving the neck or cervical region of the individual.

The Christie patent (U.S. Pat. No. 4,724,560) discloses a support pillow that includes a central air compartment surrounded by a continuous liquid compartment wherein each compartment has its own separate valve.

The Cumberland patent (U.S. Pat. No. 4,805,603) discloses a cervical traction pillow that includes a first and a second section separated by a slot wherein an air sac disposed between the sections causes the sections to separate when the air sac is inflated.

The Harper patent (U.S. Pat. No. 4,829,614) discloses an adjustable pillow that includes a neck portion and a main portion and several separately inflatable chambers extending within the pillow.

The Meade, II, patent (U.S. Pat. No. 4,979,249) discloses a support cushion enclosing a bladder that is inflatable by a hand pump.

The Sexton patent (U.S. Pat. No. 5,068,933) discloses a sleeping pillow having an inflatable air bag, a built-in air compressor, and an air exhaust control mechanism.

The Roberts patent (U.S. Pat. No. 6,131,219) discloses an inflatable pillow having a plurality of separately inflatable chambers for conforming the pillow to the specific requirements of the individual.

Nonetheless, despite the ingenuity of the above devices, there remains a need for a cushion or pillow that is quickly and easily adjustably inflatable for properly supporting and aligning the head, neck and spine of a resting, reclining or sleeping individual.

SUMMARY OF THE INVENTION

The present invention comprehends an adjustable air pillow that can be incrementally inflated or deflated to the desired height and firmness for properly aligning the head, neck and spine so that the individual obtains a satisfying and restful night's sleep.

The adjustable air pillow of the present invention includes a pliable and deformable air bladder for enclosing therein a given volume of air. Surrounding the air bladder is a removable padding having a flat bottom and a recessed upper surface for receiving and supporting therein the individual's head. A removable pillow cover is placed completely over and around the padding, and is easily removable for cleaning and washing. A control box is interconnected to the air bladder by a flexible air line, and the control box includes an internal air pump in communication with the air line for inflating and deflating the air bladder to achieve the appropriate height and firmness of the pillow. The control box also includes a control panel of switches or buttons that the individual can manipulate for either incrementally inflating or incrementally deflating the air bladder. The adjustable air pillow has the flexibility in that it can be battery powered or it can be plugged into a wall outlet and powered by standard house current.

It is an objective of the present invention to provide an adjustable air pillow that can be either battery operated or powered from standard house current.

It is another objective of the present invention to provide an adjustable air pillow that is adaptable for use at various locations such as the home, hospital, nursing home, car, boat, beach and recreational areas, camper or over-the-road tractor trailer.

It is yet another objective of the present invention to provide an adjustable air pillow that is easily adjustable so that the individual can achieve the desired height and firmness for rest, relaxation or sleep.

It is still yet another objective of the present invention to provide an adjustable air pillow that relieves the strain and pain in an individual with an arthritic neck and shoulders.

Still yet another objective of the present invention is to provide an adjustable air pillow that can be utilized by an individual sitting in a recliner or armchair while watching t.v. giving the individual maximum comfort while so disposed.

Still yet a further objective of the present invention is to provide an adjustable air pillow that can function as a lumbar cushion for individuals with back problems, especially when they are sitting or driving for long periods of time.

A still yet further objective of the present invention is to provide an adjustable air pillow that can be configured for various sizes such as standard size, twin size, and queen or king size.

Yet another objective of the present invention is to provide an adjustable air pillow that allows the individual to incrementally adjust the pressure within the pillow to obtain the optimum alignment for the individual's head, neck and spine.

Yet still another objective of the present invention is to provide an adjustable air pillow that can be brought into conformation with each individual user through the incremental inflation or deflation of the air bladder within the pillow.

These and other objects, features and advantages will become apparent to one skilled in the art upon a perusal of the following detailed description read in conjunction with accompanying drawing figures.

DETAILED DESCRIPTION OF THE PREFERRED EMBODIMENT

Illustrated in FIGS. 1–7 is a portable, adjustable air pillow 10 that allows the individual to selectively raise or lower the air pillow 10 to provide the appropriate alignment for the individual's head, neck and spine when the individual is resting, relaxing or sleeping. The incremental and selective adjustment of the vertical level and firmness of the air pillow 10 enables the individual to set the pillow 10 to the maximum comfort position thereby allowing the individual to obtain a full, sound, satisfying night's sleep. The air pillow 10 alleviates neck strain and pain, and is especially valuable for individuals with neck pains and arthritic problems. Each individual can set the air pillow 10 exactly as he or she desires—high and firm or soft and low. The air pillow 10 is portable and can be used in a wide variety of locations such as home, hospitals, nursing homes, campers, trailers, by truckers, and while reclining and laying on a recliner, couch or sofa. The air pillow 10 is also advantageous for individual's suffering from disc, lumbar and other cervical problems.

Figure 3:
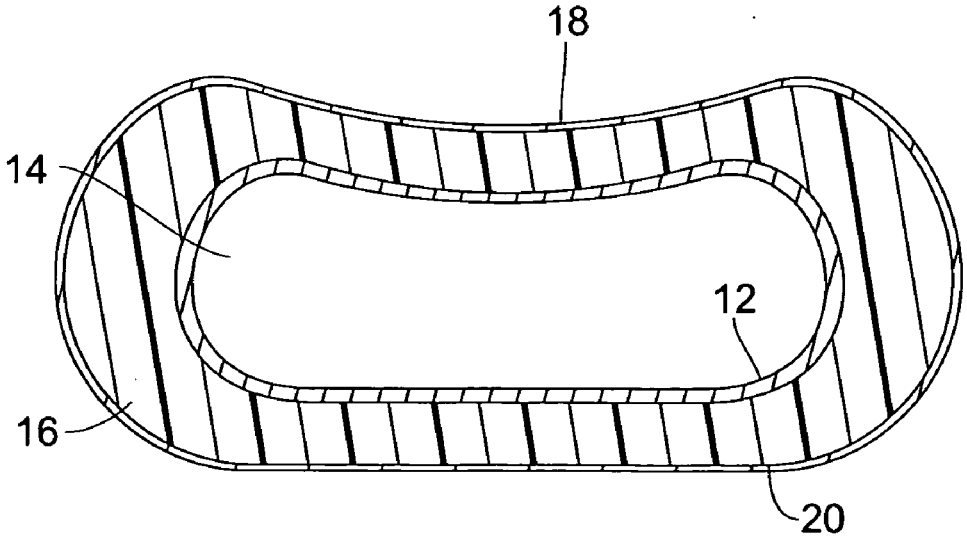
FIG. 3 is a sectioned view of the adjustable air pillow of the present invention taken along lines 3—3 of FIG. 1 illustrating the air chamber, the bladder surrounding the air chamber and the configuration of the padding.
Figure 4:
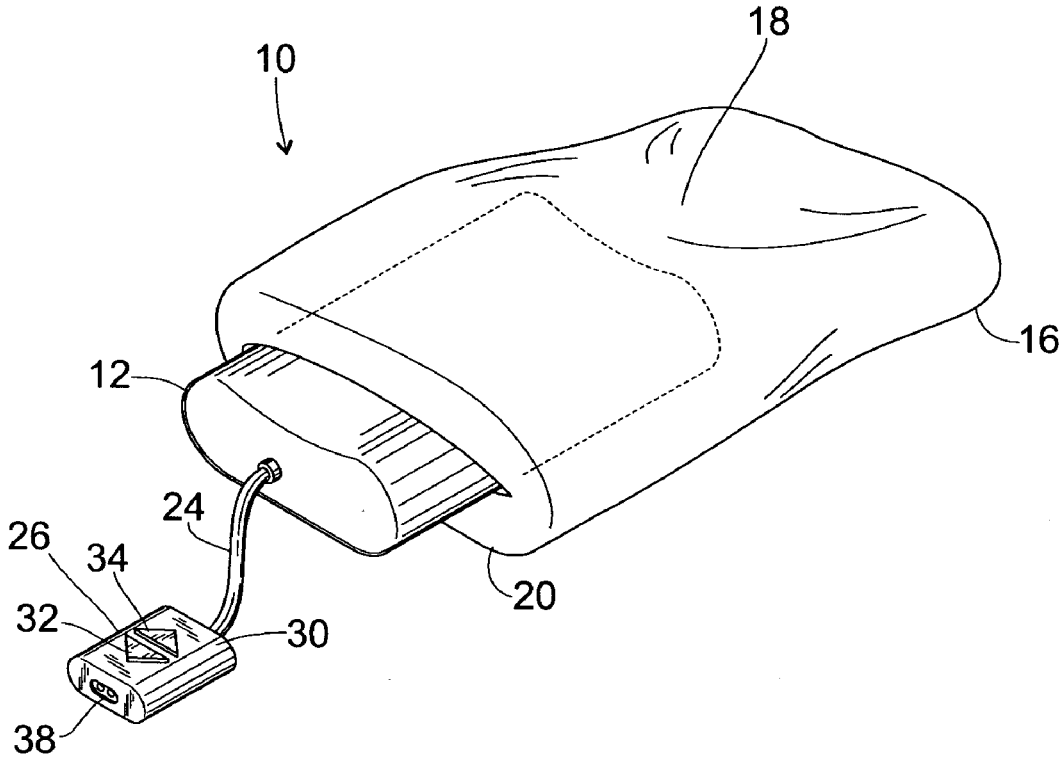
FIG. 4 is a perspective view of the adjustable air pillow of the present invention illustrating the insertion of the air bladder within the padding.
Figure 5:
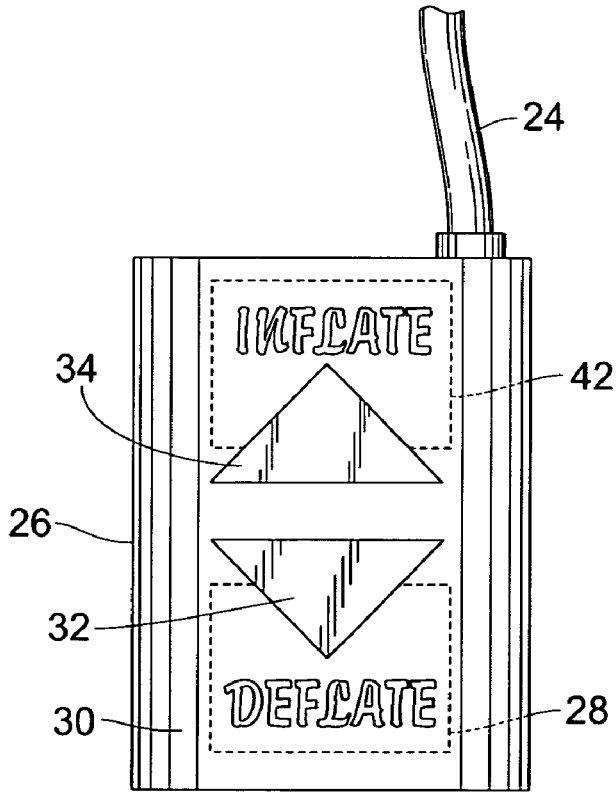
FIG. 5 is an elevational view of the adjustable air pillow of the present invention illustrating the control panel that controls the inflation and deflation of the pillow.

As shown in FIGS. 3 and 4 in the preferred embodiment of the invention, the air pillow 10 includes an elongated, rectangular-shaped air bladder 12 that is pliable and deformable to allow for inflation and deflation. The air bladder 12 encloses and defines an air chamber 14 that holds a given volume of air. The air bladder 12 is inflated when air is discharged into the air chamber 14, and the air bladder 12 is deflated when air is withdrawn or evacuated from the air chamber 14 as hereinafter further described. Completely surrounding and enclosing the air bladder 12 is a padding 16 that snugly fits on and about the air bladder 12 and is removable therefrom. The padding 16 provides yieldable support for the individual and is approximately three inches thick, and can be composed of the following materials: foam rubber, a hollow fill, polyester, down, or similar pillow padding. The padding 16 conforms to the air bladder 12 and is raised during inflation of the air bladder 12 and lowered during deflation of the air bladder 12. The padding 16 includes, as shown in FIGS. 1 and 3, a recessed or concave upper surface 18 for comfortably supporting and accommodating the individual's head and neck, and a lower or flat bottom surface 20.

Figure 2:
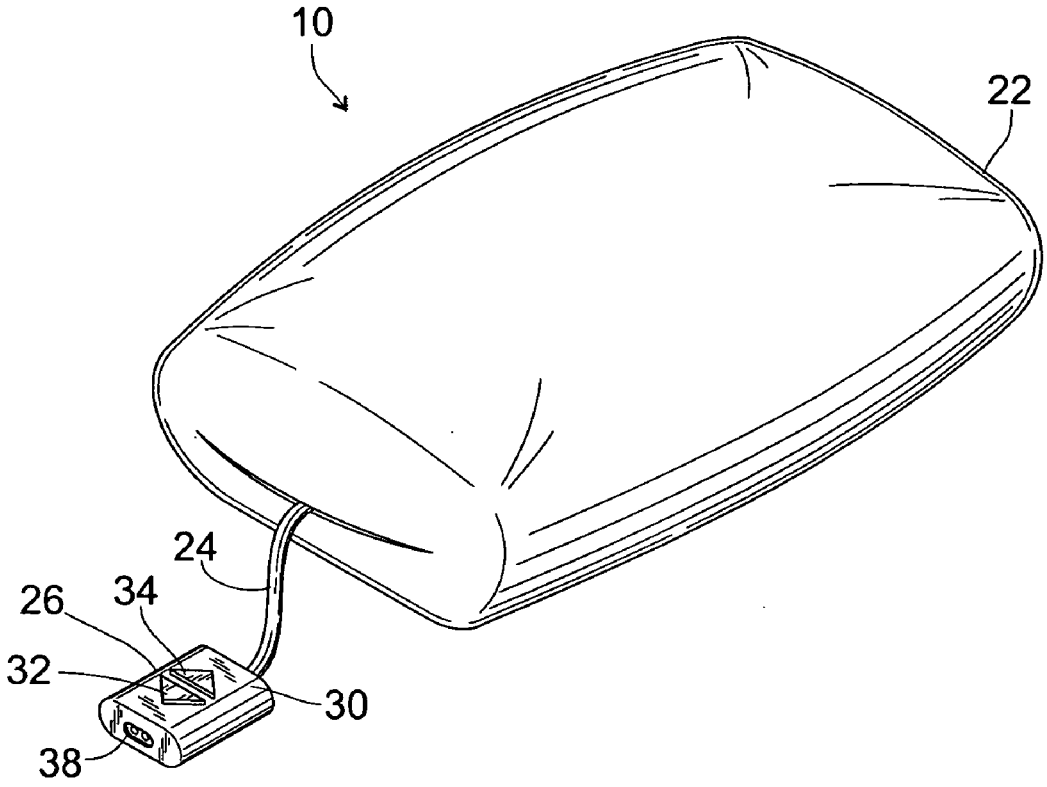
FIG. 2 is a perspective view of the adjustable air pillow of the present invention illustrating the padding encased within a pillow cover.

Illustrated in FIG. 2 is a pillowcase 22 that is slipped on and over the padding 16 for enclosing the padding 16 and providing a surface between the individual's head and the padding 16. The air pillow 10 can come in all the usual sizes including standard, queen and king size, and even a small lumbar size for use by people with back problems or by people that sit at a desk all day or drive an automotive vehicle (such as over-the-road truckers) for long periods of time.

Figure 1:
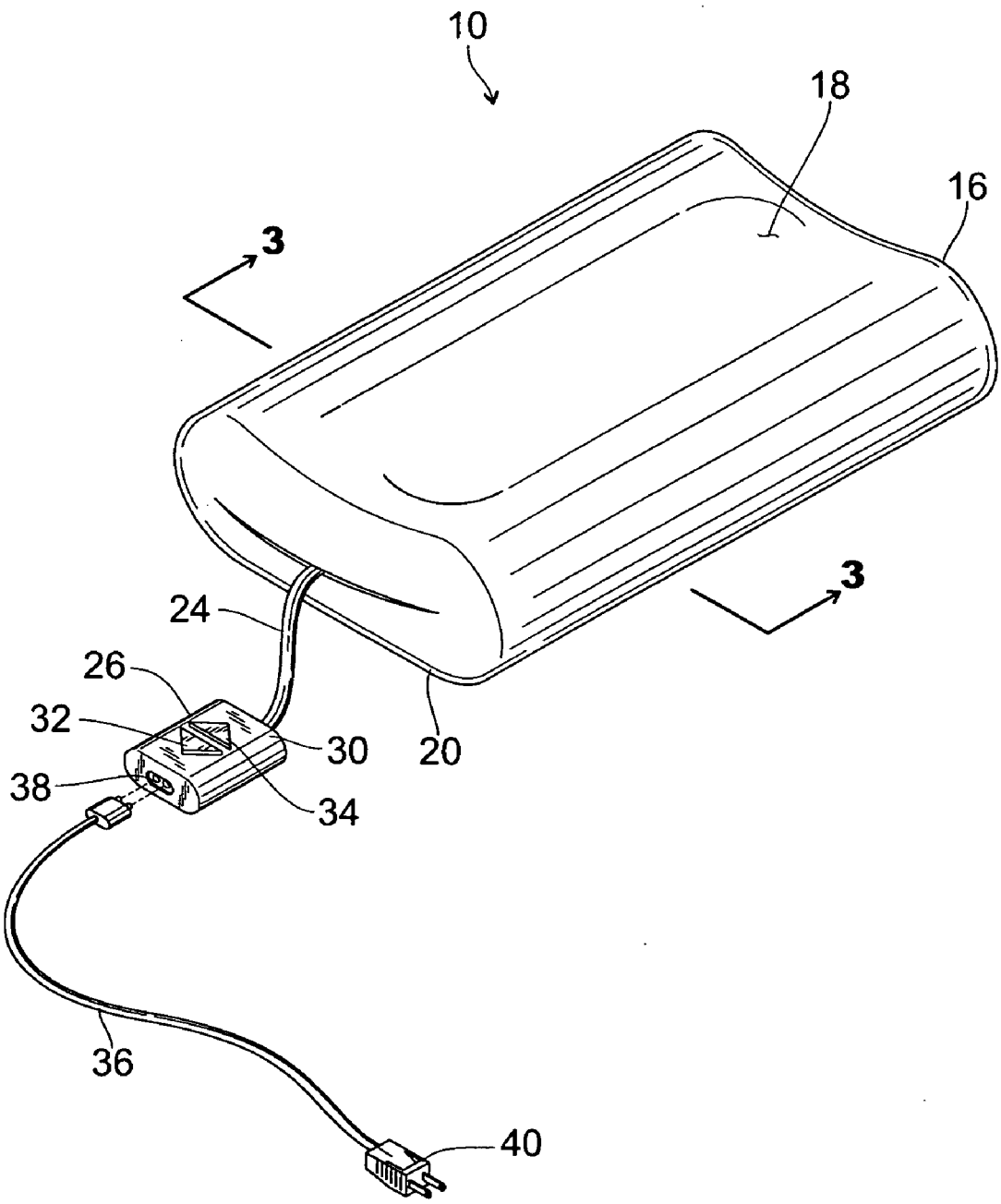
FIG. 1 is a perspective view of the adjustable air pillow of the present invention.

As shown in FIGS. 1, 2 and 4 an air inlet means is used to deliver air into the air chamber 14 to inflate the air bladder 12 and also to allow the withdrawal of air from the air chamber 14 to deflate the air bladder 12. The air inlet means includes a flexible air line 24 that is in airflow communication with the air chamber 14 through the air bladder 12. The air line 24 has one end connected to the air bladder 12 and an opposite end attached to a control box/pump housing 26. Enclosed within the control box/pump housing 26 is a mini air pump 28 of known and standard construction for directing air through the airline 24 into the air chamber 14 or withdrawing air from the air chamber 14. The control box/pump housing 26 includes a control panel 30 that includes that several manually operable control switches or buttons. As shown in FIGS. 1, 2, 4 and 5, the control switches include a deflate switch 32 and an inflate switch 34 each of which is selectively manually operable to actuate the air pump 28 for air pillow inflation or air pillow deflation.

To provide maximum flexibility in use the air pillow 10 can be battery powered or powered from standard house current. Thus, as shown in FIG. 1, a power cord 36 is removably attachable to the contacts 38 located on the control box/pump housing 26 that are electrically interconnected to the air pump 28 for powering the air pump 28 for inflation and deflation. The plug 40 of the power cord 36 is plugged into a standard wall outlet. In order to provide for the portability of the air pillow 10, the control box/pump housing 26 includes a battery compartment 42 for receiving batteries so that the air pillow 10 can be battery powered. It is possible to mount the control box/pump housing 26 in direct communication with the air bladder 12 and the air chamber 14 thereby obviating the necessity of the airline 24.

Figure 6:
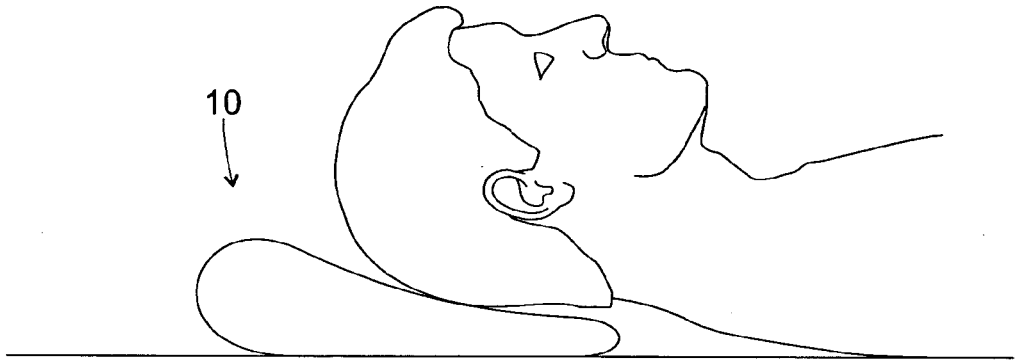
FIG. 6 is an elevational view of the adjustable air pillow of the present invention illustrating the pillow in the deflated disposition.
Figure 7:
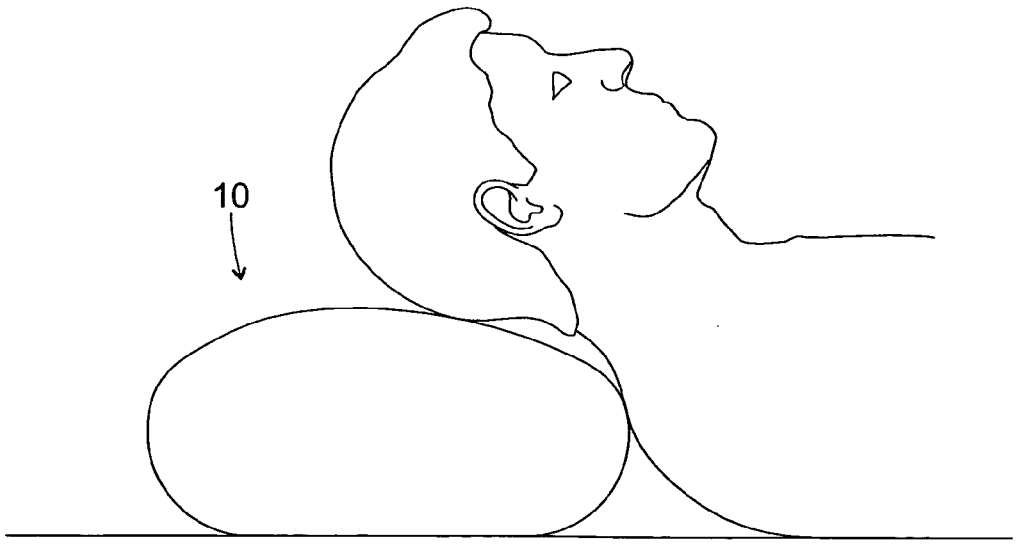
FIG. 7 is an elevational view of the adjustable air pillow of the present invention illustrating the pillow in the inflated disposition.

In order to use the air pillow 10 at, for example, one's home or at a hospital or nursing home, the power cord 36 is first plugged into the control box/pump housing 26, and then the plug 40 at the opposite end of the power cord 36 is plugged into the wall outlet. The air pillow 10 is placed on the bed with the air line 24 and the control box/pump housing 26 hanging down over the bed but within easy reach. Either by oneself, or with another individual's assistance, the control box/pump housing 26 would be held with the control panel 30 facing the individual and then the inflate switch or button 34 would be engaged to raise and firm up the pillow 10; or, alternatively, the deflate switch or button 32 would be engaged to lower and soften the pillow 10. It may take several turns of raising or lowering the pillow 10, as shown in FIGS. 6 and 7, before the individual obtains the maximum comfort position for achieving the proper alignment of the head, neck and spine. FIG. 6 illustrates a deflated disposition of the air pillow 10, and when the air pillow 10 is fully deflated the air pillow 10 is approximately two inches high; while FIG. 7 illustrates an inflated disposition of the air pillow 10, and when the air pillow 10 is fully inflated, the air pillow 10 is approximately eight inches in height. Thus, by manually engaging the inflate or deflate switches 32 and 34, the individual can incrementally raise or lower the air pillow 10 and thereby adjust the air pillow 10 to achieve his or her maximum comfort position—either high and firm or low and soft.

While a particular embodiment of the invention has been shown and described in detail herein, it should be understood that numerous modifications, alterations, and variations may be possible and practicable without departing from the spirit of the invention as defined by the scope of the appended claims.

I claim:

1. An adjustable air pillow for obtaining the proper alignment of the individual's head, neck and spine, comprising:

a single, pliable and deformable, generally rectangularly shaped air bladder enclosing an air chamber that holds a given volume of air;

a padding removably attachable to the air bladder surrounding and conforming to the air bladder the padding being approximately three inches thick;

the padding including a recessed concave upper surface for supporting thereon the head and neck of the individual and a flat bottom surface;

air inlet means in registration with the air bladder for discharging air into the air chamber and evacuating air from the air chamber;

an air pump interconnected to the air inlet means for directing air through the air inlet means into the air chamber and evacuating air from the air chamber; and a manually operable control means interconnected to the air pump for selectively discharging air into the air chamber for inflating the air bladder and increasing the height and firmness of the air pillow and for selectively evacuating air from the air chamber deflating the air bladder and thus decreasing the height and firmness of the air pillow whereupon the inflation and deflation of the air bladder allows for the adjustment of the air pillow to obtain the proper alignment of the individual's head, neck and spine.

2. The adjustable air pillow of claim 1 wherein the air inlet means includes a flexible air line in flow communication with the air pump and the air bladder.

3. The adjustable air pillow of claim 1 wherein the control means includes a manually operable switch that has an inflate position and a deflate position.

4. The adjustable air pillow of claim 3 wherein the air pump is battery powered.

5. The adjustable air pillow of claim 4 wherein the air pump is powered by standard house current.

6. The adjustable air pillow of claim 1 further comprising an air pump housing for housing therein the air pump.

7. The adjustable air pillow of claim 1 wherein the air pump housing is directly attached to the air bladder so that the air pump is in direct registration with the air chamber for discharging air therein and evacuating air therefrom.

* * * * *